US007299829B2

(12) United States Patent
Kim

(10) Patent No.: US 7,299,829 B2
(45) Date of Patent: Nov. 27, 2007

(54) APPARATUS FOR AUTOMATICALLY BINDING REINFORCING RODS

(75) Inventor: Yong-jin Kim, Daejeon (KR)

(73) Assignee: HANA Corporation, Chungnam (KR)

( * ) Notice: Subject to any disclaimer, the term of this patent is extended or adjusted under 35 U.S.C. 154(b) by 112 days.

(21) Appl. No.: 10/569,410

(22) PCT Filed: Dec. 23, 2003

(86) PCT No.: PCT/KR03/02809

§ 371 (c)(1),
(2), (4) Date: Feb. 23, 2006

(87) PCT Pub. No.: WO2005/021893

PCT Pub. Date: Mar. 10, 2005

(65) Prior Publication Data

US 2007/0000555 A1 Jan. 4, 2007

(30) Foreign Application Priority Data

Aug. 29, 2003 (KR) ..... 10-2003-0060444

(51) Int. Cl.

| | |
|---|---|
| ***B21F 7/00*** | (2006.01) |
| ***B21F 15/02*** | (2006.01) |
| ***B21F 9/02*** | (2006.01) |
| ***B65B 13/28*** | (2006.01) |

(52) U.S. Cl. ..... 140/119; 140/93.6; 140/122; 100/31

(58) Field of Classification Search ..... 140/57, 140/93.6, 119, 122, 149; 100/26, 31
See application file for complete search history.

(56) References Cited

U.S. PATENT DOCUMENTS

| | | | | |
|---|---|---|---|---|
| 4,947,902 | A | 8/1990 | Lehmann et al. | |
| 5,881,452 | A | 3/1999 | Nowell et al. | |
| 5,947,166 | A * | 9/1999 | Doyle et al. | 140/119 |
| 7,051,650 | B2 * | 5/2006 | Kusakari et al. | 100/31 |

FOREIGN PATENT DOCUMENTS

| | | |
|---|---|---|
| JP | A-63-191719 | 8/1988 |

* cited by examiner

*Primary Examiner*—Derris H. Banks
*Assistant Examiner*—Teresa M. Bonk
(74) *Attorney, Agent, or Firm*—Morgan, Lewis & Bockius LLP

(57) ABSTRACT

An apparatus for automatically binding reinforcing rods including a case having a predetermined shape at which reinforcing rods are forwardly attached, a binding-wire supplying device formed at a rear part of the case, a binding-wire feeding device for advancing the binding-wire, a rotary binding-wire guiding device, a binding-wire cutting device, and a binding-wire twisting device.

15 Claims, 10 Drawing Sheets

APPARATUS FOR AUTOMATICALLY BINDING REINFORCING RODS

TECHNICAL FIELD

The present invention relates to an apparatus for automatically binding reinforcing rods capable of automatically accomplishing a wire fastening operation used for securely binding the reinforcing rods used in a building construction or civil engineering works to each other.

BACKGROUND ART

In a prior art, a worker binds reinforcing rods with a wire to securely fasten the reinforcing rods to each other prior to pouring operation of concrete slab in a construction field. In order to accomplish the binding operation, those skilled in the art use a binding hook to wrap a crossing part of the reinforcing rods with the wire and twist both ends of the wire with the binding hook.

However, this operation is, as circumstances require, accomplished at a place far from the ground, and a binding performance of the reinforcing rods is different from depending upon an expertness of the operator, thereby requiring a high wages more than operators of the other processes. Therefore, a construction cost is increased, and an industrial disaster such as an injury from a fall of the operator occurs.

Therefore, the applicant of the present invention has proposed Korean Patent Application No. 2002-0032614 entitled "Apparatus for automatically binding reinforcing rods and a binding-wire used therein" in order to accomplish this operation without an individual skill.

Referring to the above patent, the apparatus comprises a case having an inserting groove in which a reinforcing rods is inserted, binding-wire receiving means installed at one side of the case and in which the binding-wire is stored, binding-wire feeding means installed at one side of the case to extract the binding-wire forward, and a rotary binding-wire guider installed at a front end of the case to rotatably guide the binding-wire supplied from the feeding means to surround the reinforcing rods.

Further, a fastening fan having a plurality of wings is closely installed at one side rear end of the rotary binding-wire guider and rotatably connected to a rotary shaft for twisting the binding-wire surrounding the reinforcing rods to guide the binding-wire to twist the both ends of the binding-wire.

In addition, in order to cut the binding-wire surrounding the reinforcing rods, when a power switch becomes "on" to energize the power source by an operation of the operation button, a rotary gear is rotated to operate a blade of a cutter vertically installed.

In order to obtain a dynamic power of a prior art reinforcing rods auto-binder, two independent driving motors are operated. A first driving motor is formed to rotate the rotary gear for winding the binding-wire on the reinforcing rods. And, a second driving motor is connected to a flexible shaft to twist the cut binding-wire.

This flexible shaft is used as power transmission means of non-straightness, the power being transmitted to a distal end of the shaft while it making noise.

Further, an excessive vibration is generated to increase a damage rate due to a friction between the parts.

In addition, a momentum applied to the distal end of the shaft is decreased to make a twisting force of the binding-wire weaken, thereby preventing the reinforcing rods from fixedly binding.

And, a weight of the binder becomes heavy due to a plurality of driving motors. This adds an extra fatigue of an operation of an operator, and has a close relationship with a decrease of an operation performance.

At the same time, a binding-wire feeding apparatus is consisted of a rack horizontally movable by an operation button, and a pinion rotatable by the rack, thereby making the binding-wire be extracted forward by a binding-wire lead tap.

The forward extraction of the binding-wire by the binding-wire lead tap generates a phenomenon that the binding-wire is separated due to its bending to be guided to the end of the rotary gear unstably, according to circumstances, the forwardly extracted binding-wire is retracted again by catching in the lead tap as the operation button is returned.

DISCLOSURE OF INVENTION

To solve the problem, it is an object of the present invention to provide an apparatus for automatically binding reinforcing rods, for driving a rotary gear and a binding-wire twisting device for twisting a binding-wire by means of one motor, provided with a new binding-wire feeding device and a binding-wire cutting device.

To accomplish the above objects, an apparatus for automatically binding reinforcing rods of the present invention comprises a case having a predetermined shape at which reinforcing rods are forwardly attached; a binding-wire supplying device of which a binding-wire is wound on a cylindrical reel formed at a rear part of the case; a binding-wire feeding device for advancing the binding-wire by moving forward the binding-wire supplied from the binding-wire supplying device in a state that the binding-wire is caught by an operation of an activating lever, and operating a first switch; a rotary binding-wire guiding device at which the advanced binding-wire is mounted on the rotary gear by the binding-wire feeding device and the driving motor is rotated by the operation of the first switch to make the rotary gear rotate around the reinforcing rods to surround the reinforcing rods; a binding-wire cutting device for cutting the binding-wire wound on the reinforcing rods as the driving motor is reversely rotated by operating a second switch by using the rotary gear of the rotary binding-wire guiding device; and a binding-wire twisting device for twisting the binding-wire by a twister formed at one end of a twister shaft by a rotational force generated from the driving motor in order to twist the both ends of the binding-wire cut by the binding-wire cutting device.

The binding-wire feeding device is fixedly rotated to a feeding hinge when the operation lever is retracted, preferably, its one side is hinged to the operation lever, and the feeder is advanced at the other side by a feeding shaft hinged to the feeder.

Further, preferably, an inserting hole, in which the binding-wire extracted from the supplying device is inserted and guided to a front end, is formed; and a feeder is hinged to press the binding-wire with a feeding pin by a resilient force of a spring as a certain section of the inserting hole is exposed.

The rotary binding-wire guiding device comprises a driven bevel gear engaged with a driving bevel gear formed at a shaft of the driving motor to transmit a power; a timing driving gear integrally formed with the driven bevel gear; a first and a second timing gears, on which a timing belt for transmitting a rotational force of the timing driving gear, installed at an adjacent section of a linear gear; and a first and a second pinions integrally formed with the first and the second timing gear, wherein the rotary binding-wire guiding device preferably rotates the rotary gear at which a reinforcing rod guider for attaching the reinforcing rods is formed.

In addition, the rotary gear preferably has a slot for preventing the binding-wire from separating during a rotation of the rotary gear into a section in vicinity of the binding-wire cutting device at one side, and a binding-wire catching protrusion formed at the slot and at which the binding-wire is caught.

In this connection, the rotary gear is preferably provided with a protruded surface for operating the second switch at an opposite surface of the surface at which the catching protrusion is installed.

The binding-wire cutting device comprises a cutter installed at a section in vicinity of an extraction pipe installed at an extended line in an advancing direction of the binding-wire extracted from the binding-wire feeding device; a supporter, at which a rotary shaft for rotating the cutter is installed, integrally formed with the extracting pipe; a one-way clutch bearing fixed to the supporter to support the rotary shaft; and a torsion spring installed at the other side of the cutter of the rotary shaft to return the cutter.

Further, preferably, the twister driving gear, at which the one-way clutch bearing is installed to be rotated in an opposite direction to a rotational direction of the driving bevel gear in a state of adjacent of the driving bevel gear installed at the driving shaft of the driving motor, is cooperated with a twister driven gear installed at a distal end of the twister shaft in order to cut the binding-wire as a pestle, installed at the twister shaft and having a regular gap by a hooking pin, strikes a blade of the cutter.

And, the present invention comprises a cam installed at a periphery of the one-way clutch bearing supporting the rotary shaft of the supporter; a return guide which a certain slope is formed to guide the cam; a stopper, at which the return guide is attached, extended from the operation lever; a catching bar formed at the stopper to pull the stopper in a moving direction of the operation lever; and a latch having a hook to be locked to the catching bar at its one end, a protrusion at the other end, and a spring hinged to the hook and a center of the protrusion and installed at a bottom surface of the hook to prevent the hook from sagging, wherein the protrusion is caught by a hook falling bar fixed to the case to rotate the hook to be separated from the catching bar when the latch is moved to more than a certain distance along the operation lever.

BRIEF DESCRIPTION OF THE DRAWINGS

These and other features, aspects, and advantages of preferred embodiments of the present invention will be more fully described in the following detailed description, taken accompanying drawings. In the drawings.

BEST MODES FOR CARRYING OUT THE INVENTION

Hereinafter, a preferred embodiment of the present invention will be more specifically described in conjunction with the accompanying drawings.

Hereinafter, while the description through the drawings is added to facilitate more thorough understanding of the present invention, it will be apparent to those skilled in the art that the present invention is implemented without a detailed description thereof.

According to circumstances, descriptions of known characteristics and components are omitted for clarity essential parts of the present invention. The reason for this is that the present invention prevents the description from unnecessarily obscuring.

Figure 1:
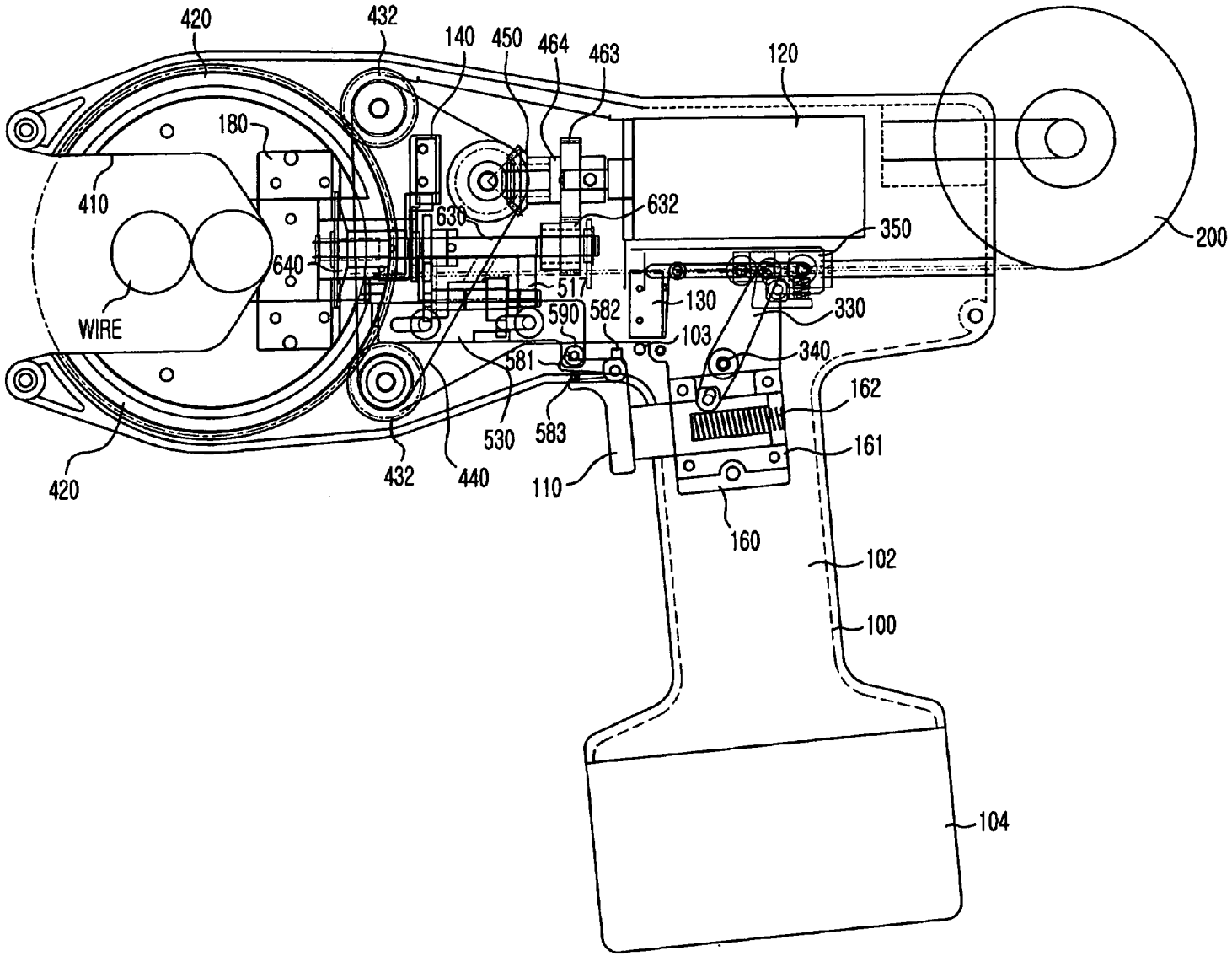
FIG. 1 is a cross-sectional view for illustrating an overall constitution of an apparatus for automatically binding reinforcing rods in accordance with the present invention.

FIG. 1 is a cross-sectional view for illustrating an overall constitution of an apparatus for automatically binding reinforcing rods in accordance with the present invention. As shown in FIG. 1, the apparatus for automatically binding reinforcing rods comprises a case 100, a binding-wire supplying device 200, a binding-wire feeding device 300, a rotary binding-wire guiding device 400, a binding-wire cutting device 500, and a binding-wire twisting device 600.

First, the case 100 has a pistol shape, and a power source 104 is installed at a lower end of the handle 102 to supply a power to a driving motor. The power source employs a conventional power source for an electric tool.

The binding-wire supplying device 200 is formed at a right side to a center of the FIG. 1. The binding-wire supplying device 200 is provided with a cylindrical reel, at which the binding-wire is wound, and a one-way clutch bearing hinged to a center of the reel to supply smoothly the binding-wire and prevent the reel from reversely rotating to prevent the binding-wire from retracting.

The binding-wire feeding device 300 is installed at a crossing part of the handle 102 and the binding-wire supplying device 200.

The rotary binding-wire guiding device 400 is installed at a left side to a center of FIG. 1, that is, corresponded to a front part of the present invention, and has a shape, which a part of the rotary gear 420 is opened such that the reinforcing rods are located at an inner side of the rotary gear 420. The rotary gear catches the binding-wire and rotates about the reinforcing rods when the reinforcing rods to be bound are located at an inner side of the rotary gear 420 at which the opened reinforcing rods guider 410 is formed.

The binding-wire cutting device 500 is located at a rear part of the rotary binding-wire guiding device 400 to cut the binding-wire after the binding-wire is wound on the reinforcing rods.

The binding-wire twisting device 600 for twisting the binding-wire wound on the reinforcing rods is operated after the binding-wire is cut by the binding-wire cutting device 500.

Figure 2:
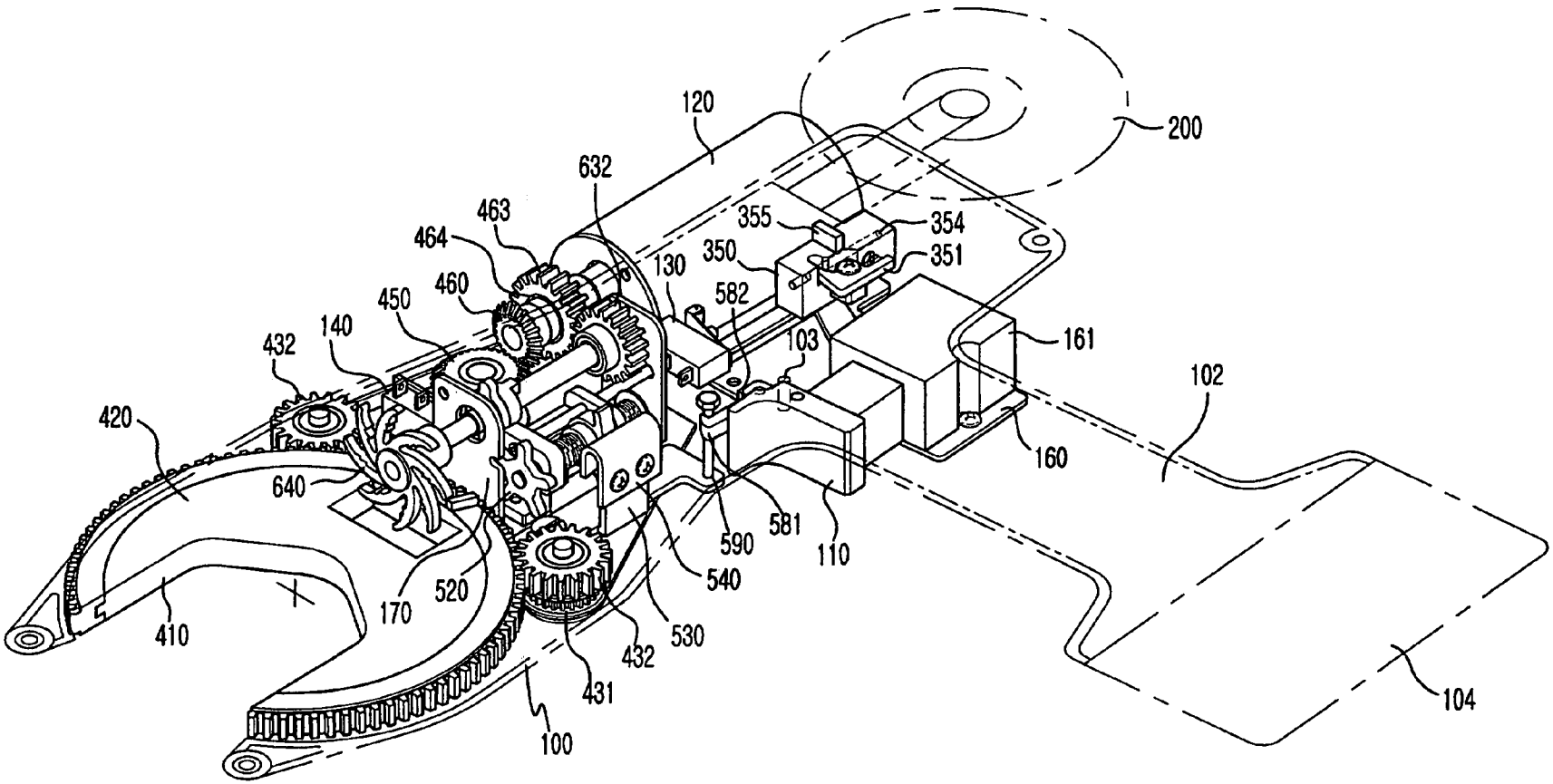
FIG. 2 is an overall perspective view of the apparatus for automatically binding reinforcing rods in accordance with the present invention.
Figure 3:
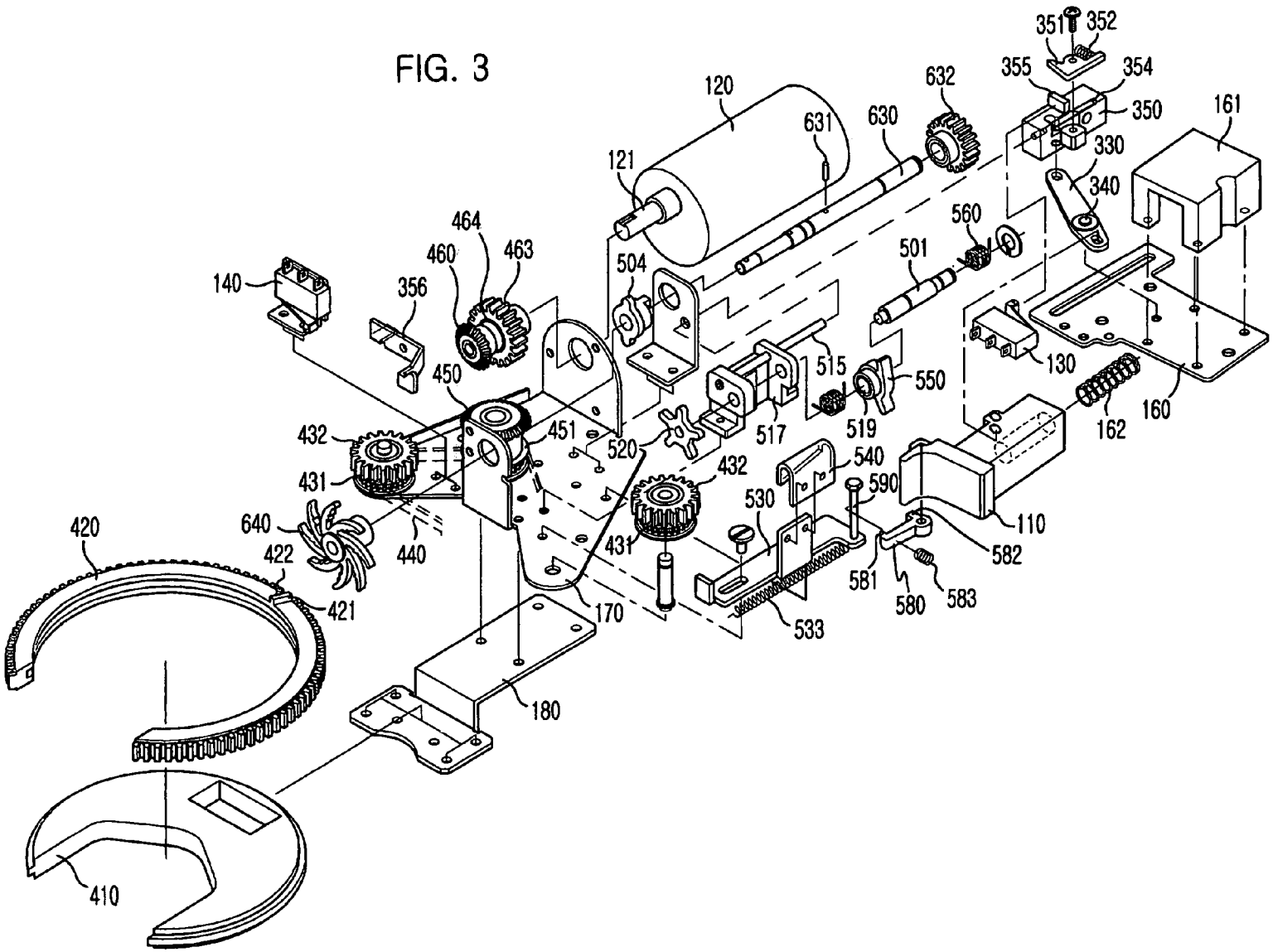
FIG. 3 is an overall disassembled perspective view of the apparatus for automatically binding reinforcing rods in accordance with the present invention.

FIG. 2 is an overall perspective view of the apparatus for automatically binding reinforcing rods in accordance with the present invention; FIG. 3 is an overall disassembled perspective view.

As shown in these drawings, first, a driving motor 120 for driving the binding-wire guiding device 400 and the binding-wire twisting device 600 is explained on focused.

Installed at a main bracket 170, having a predetermined shape, fixed to the case 100 is a driven bevel gear 450 engaged with a driving bevel gear 460 formed at a shaft of the driving motor 120 to transmit a power.

In addition, a timing driving gear 451 is installed with integrally formed with the driven bevel gear 450, a timing belt 440 is mounted to transmit a rotational force of the timing driving gear 451, and a first and a second timing gears 431 are installed at an adjacent section of a rotary gear 420.

And, the rotary binding-wire guiding device 400 is constituted to rotate the rotary gear 420, at which the reinforcing rods guider 410 is formed, and the reinforcing rods guider 410 attaches the reinforcing rods by the first and the second pinion integrally formed with the first and the second timing gears 431.

Figure 4:
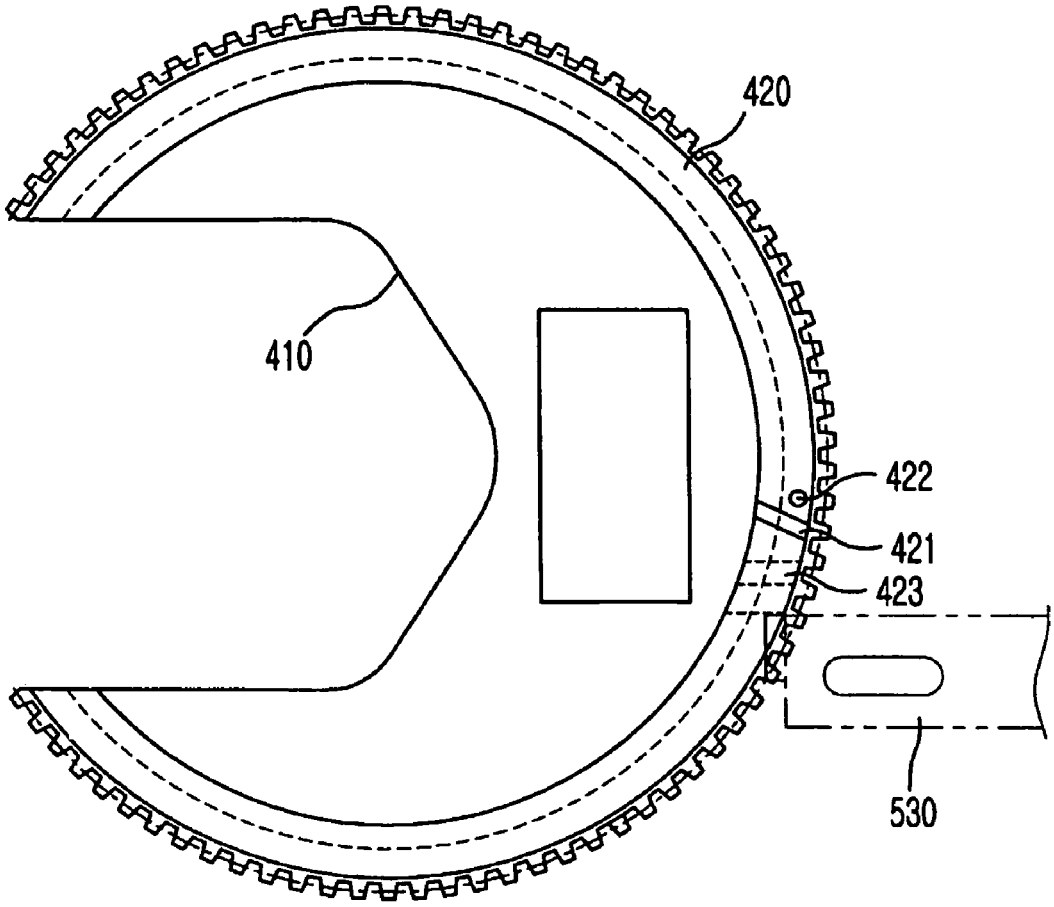
FIG. 4 is a front view of a rotary gear in accordance with the present invention.

The rotary gear 420 is, as shown in FIG. 4, provided with a slot 421 for preventing the binding-wire from separating during a rotation of the rotary gear 420 at an adjacent section of the binding-wire cutting device 500, and guides the binding-wire. And, a binding-wire catching protrusion 422, on which the binding-wire is mounted, is formed in the slot 421, and the binding-wire is interposed between the slot 421 and the catching protrusion 422 on a rotation of the rotary gear 420, thereby surrounding the reinforcing rods depending upon the rotation of the rotary gear 420.

Figure 5:
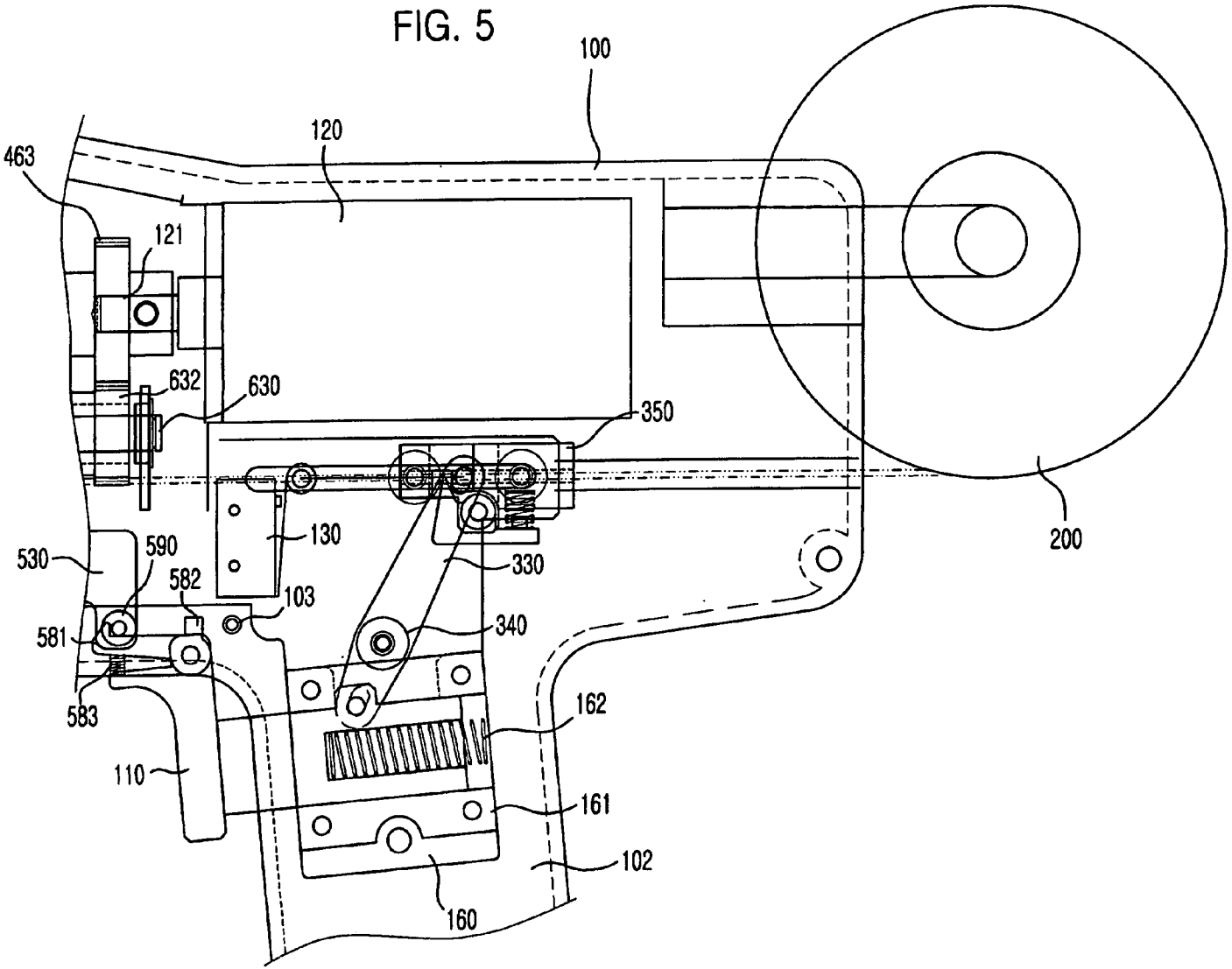
FIG. 5 is a partially enlarged view of FIG. 1 for illustrating a binding-wire feeding device in accordance with the present invention.

FIG. 5 is a partially enlarged view of FIG. 1 for illustrating the binding-wire feeding device.

As shown in FIG. 5, the binding-wire feeding device 300 is installed to expose an operation lever 110 having a predetermined trigger shape to an exterior of the case 100. The operation lever 110 is installed, as shown in FIG. 5, to be returned by a first spring 162 having a resilient force.

The operation lever 110 is fixed to a feeding hinge 340, and a feeding shaft 330 provided with one side hinged to the operation lever 110 and the other side hinged to the feeder 350 advances the feeder 350 forward.

Figure 6:
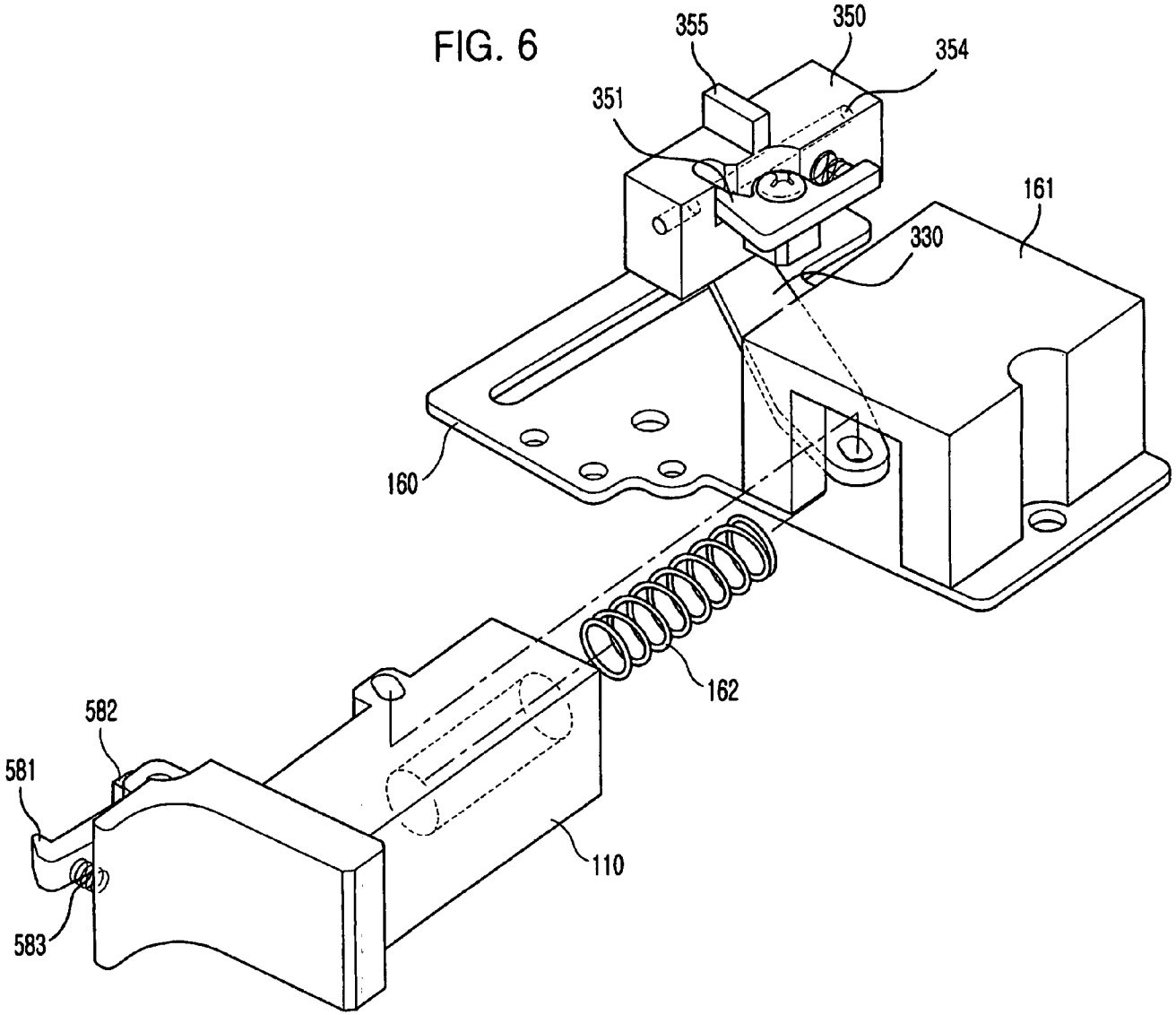
FIG. 6 is a perspective view for illustrating a binding-wire feeding device mounted on a handle bracket in accordance with the present invention.

FIG. 6 is a perspective view for illustrating the binding-wire feeding device mounted on a handle bracket, and the above constitution will be more specifically described in conjunction with FIG. 6.

The handle bracket 160 is installed at the handle 102 of the case 100. The handle bracket 160 is provided with an operation lever guide housing 161, for guiding a movement of the operation lever 110, in which a first spring 162 is installed. And, the operation lever 110 is hinged to one side of the feeding shaft 330. The first spring 162 is returned to an original position by its resilient force after the operation lever 110 is retracted.

And, a certain section of the feeding shaft 330 is hinged to the handle bracket 160 by a feeding hinge 340. Further, the other side of the feeding shaft 330 is hinged to the feeder. When the operation lever 110 is retracted by this structure, one side of the feeding shaft 330 is hinged, and the other side rotatable to the handle bracket 160 by the feeding hinge 340 advances, i.e., moves in the reverse direction of the retracting direction of the operation lever 110. At this time, the feeder 350 hinged to the other side of the feeding shaft 330 also advances.

Figure 7:
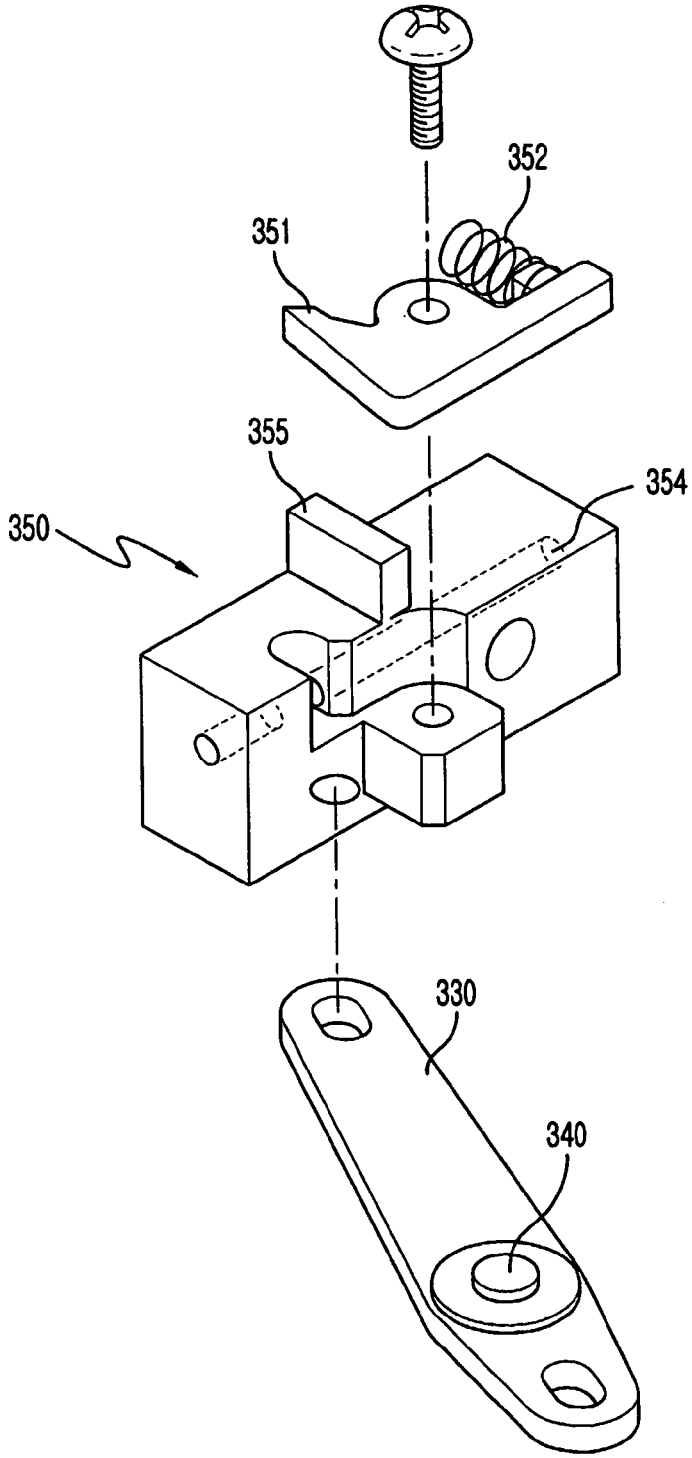
FIG. 7 is a disassembled perspective view of a feeder in accordance with the present invention.

FIG. 7 is a disassembled perspective view of the feeder. The feeder 350, at which the other side of the feeding shaft 330 is hinged, moves on the handle bracket 160. And, an inserting hole 354, at which the binding-wire extracted from the binding-wire supplying device 200 is inserted and guided to a front part, is formed. A certain section of the inserting hole 354 is exposed, and the feeding pin 351 is hinged to press the binding-wire by a resilient force of the spring 352.

This structure is capable of advancing with caught the binding-wire when the feeding device 300 advances. Also, a first switch contact surface 355, for operating the driving motor 120 as the feeder 350 advances, is formed at one side of the feeder 350.

Figure 8:
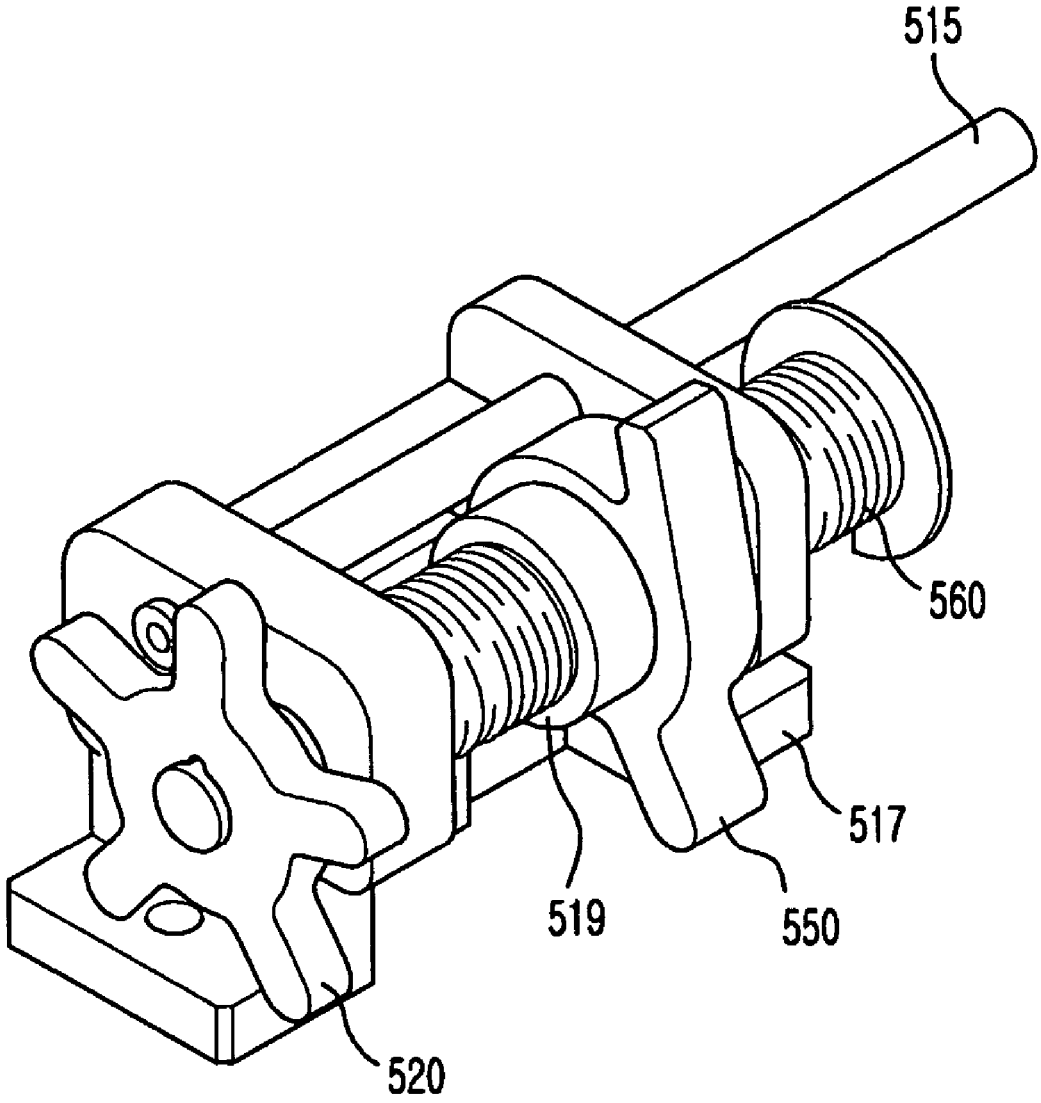
FIG. 8 is a perspective view of a binding-wire cutting device in accordance with the present invention.
Figure 9:
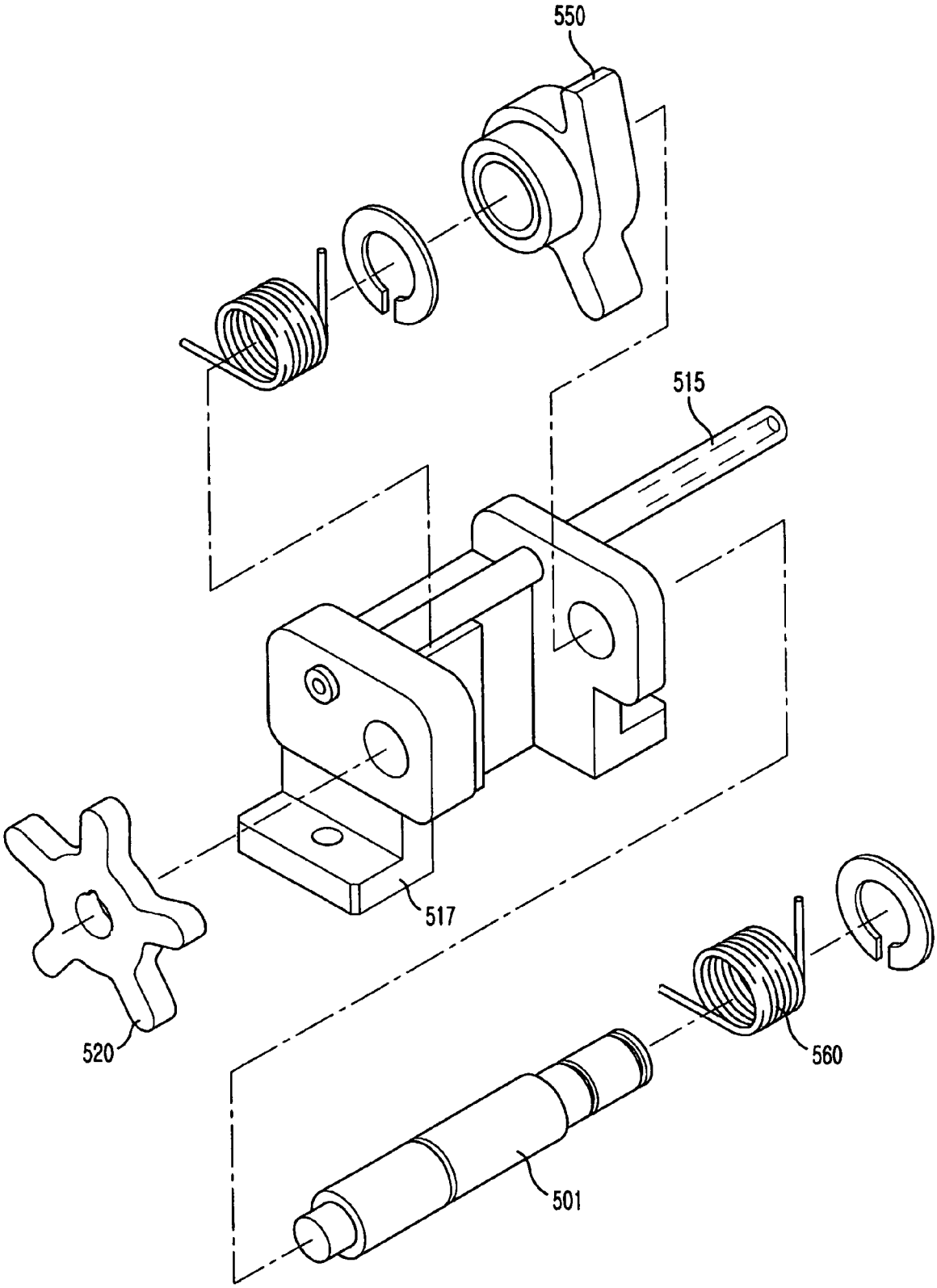
FIG. 9 is a disassembled perspective view of a binding-wire cutting device in accordance with the present invention.

FIG. 8 is a perspective view of the binding-wire cutting device, and FIG. 9 is a disassembled perspective view of the binding-wire cutting device. As shown in these drawings, the binding-wire cutting device 500 is installed at an adjacent section of an extraction pipe 515 installed at an extended line in the advancing direction of the binding-wire extracted from the binding-wire feeding device 300.

In this connection, carefully observing the binding-wire cutting device 500, the rotary shaft 501 for rotating the cutter 520 is installed, and a supporter 517 integrally formed with the extraction pipe 515 is fixed to a main bracket 170.

The cutter 520 is returned to its original position by the one-way clutch bearing 519 fixed by the supporter 517 to support the rotary shaft 501, and the torsion spring 560 installed at the other side of the cutter 520 of the rotary shaft 501. Therefore, the binding-wire advances along the extraction pipe 515 to be located closely at the cutter 520.

Figure 10:
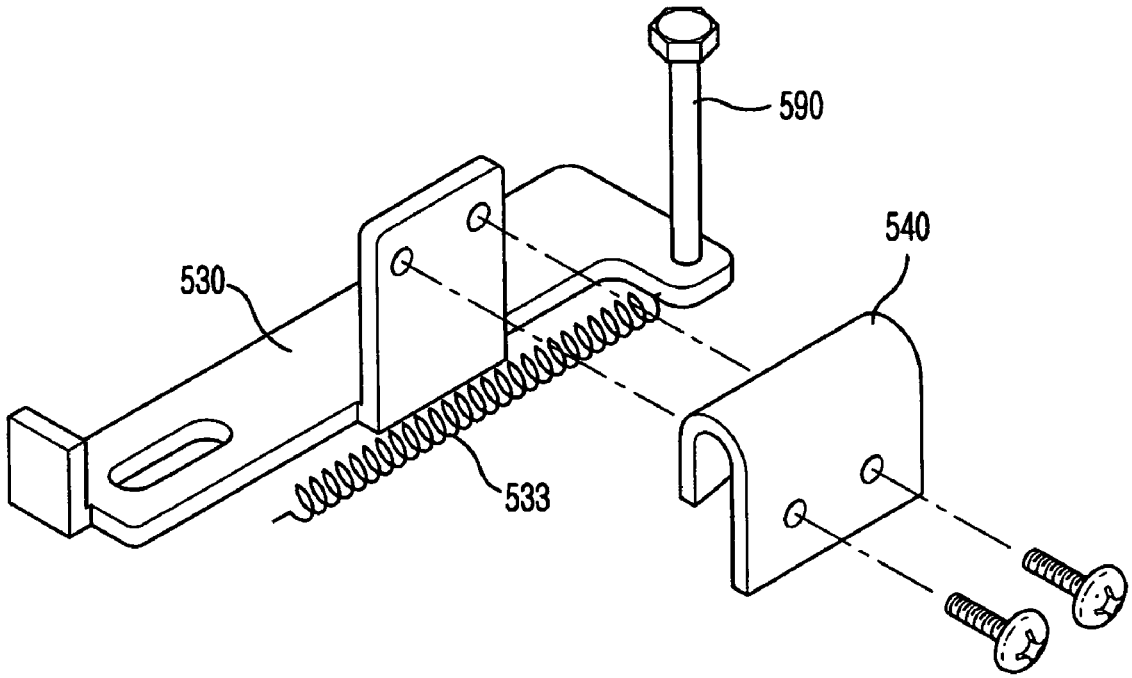
FIG. 10 is a perspective view for illustrating a stopper in accordance with the present invention.

FIG. 10 is a perspective view of a stopper.

The stopper 530 extended from the operation lever 110 is located on the main bracket 170 to be pin fastened along an elongated hole formed at the stopper 530 to be guided. And, a return spring 533 is interposed between the stopper 530 and the case 100. Also, a return guide 540, at which a certain slope is formed to guide the cam 550 installed at an outer periphery of the one-way clutch bearing 519 supporting the rotary shaft 501 of the supporter 517 of the binding-wire cutting device 500, is threadedly fastened to the stopper 530.

And, a catching protrusion 590 is formed at the stopper 530 in order to pull the stopper 530 in the moving direction of the operation lever 110. A latch 580 having a hook 581 for hooking one end of a catching bar 590, the other end provided with a protrusion 582 and hinged to a center of the hook 581 and the protrusion 582, and a compression spring 583 installed at a lower surface of the hook 581 to prevent the hook from sagging, is installed further, when the latch 580 is moved along the operation lever 110 more than a certain distance, the protrusion 582 is hooked by the hook falling bar 103 fixed to the case 100, and the hook 581 is rotated to be separated from the catching bar 590.

Hereinafter, an operation of the apparatus for automatically binding reinforcing rods comprising the binding-wire supplying device 200, the binding-wire feeding device 300, the rotary binding-wire guiding device 400, the binding-wire cutting device 500, and the binding-wire twisting device 600 will be described.

When the reinforcing rods are located at the reinforcing rods guider 410 formed at the rotary gear 420 to bind the reinforcing rods, the operator retracts the operation lever 110. The feeding shaft 330, of which one side is hinged to the operation lever 110, advances the other end about the feeding hinge 340.

At this time, the latch 580 hinged to the operation lever 110 catches the catching bar 590 of the stopper 530 to retract the stopper 530. Also, the cam 550 of the binding-wire cutting device 500 is rotated to a certain extent along the return guide as the stopper 530 retracts, thereby rotating the rotary shaft 501. However, the cam 550 and the rotary shaft 501 does not affect since the one-way clutch bearing 519 is installed.

And, as the other side of the feeding shaft 330 advances, the hinged feeder 350 also advances. At this time, the feeding pin 351 of the feeder 350 advances with catching the binding-wire. And, the first switch contact surface 355 formed at one side of the feeder 350 operates the first switch 130.

Therefore, a rotation of the driving motor 120 starts, and the driving bevel gear 460 installed at the driving shaft 121 rotates. The driving bevel gear 460 transmits the rotational force to the driven bevel gear 450, and the timing driving gear 451 integrally formed with the driven bevel gear 450 is rotated. And, the timing driving gear 451 rotates the first and the second timing gears 431 engaged with the timing belt 440.

The first and the second pinions 432 integrally formed with the first and the second timing gears 431 rotate the rotary gear 420.

Further, the binding-wire advanced to the slot 421 of the rotary gear 420 by the feeding pin 351 of the feeder 350 is supported by the binding-wire catching protrusion 422 to be wound on the reinforcing rods along the rotary gear 420. When the rotary gear 420 is rotated and returned to the original position, the protruded surface 423 formed at the opposite surface of the rotary gear 420 touches the second switch contact piece. The second switch contact piece is rotatably hinged to operate the second switch 140.

The second switch 140 rotates the driving motor 120 from a forward rotation to a reverse rotation, and the twister driving gear 463 fastened with the one-way clutch bearing 464 is rotated. At this time, because the one-way clutch bearing 464 does not affect the driving bevel gear 460 in spite of the rotation of the twister driving gear 463, when the reverse rotation of the driving motor 120 is actually started, the binding-wire is surrounded on the reinforcing rods.

The rotation of the twister driving gear 463 leads to the rotation of the twister driven gear 632 of the twisting device 600, thereby rotating the twister shaft 630 also. The twister 640 is rotated at a distal end of the twister shaft 630.

A number of wings are formed at the twister 640, the binding-wire supplied from the feeder 350 is securely adhered one of the wings, and the binding-wire wrapped around the reinforcing rods is securely adhered to one of the wings of the twister 640 again depending upon the rotation of the rotary gear 420, thereby twisting the binding-wire by the rotation of the twister 640.

And, coincidently with the operation of twisting the binding-wire by the rotation of the twister 640, the cutting of the binding-wire is accomplished.

In accordance with the cutting of the binding-wire, the pestle 504 is rotated through the twister shaft 630 having a regular gap by the catching pin 631 on the rotation of the twister shaft 630, and the rotated pestle 504 strikes the cutter 520 to cut the binding-wire.

Further, the operation lever 110 is finally retracted, the falling bar 102 formed at the case collides the protrusion part 582 of the latch 580 hinged to the operation lever 110, thereby releasing the catching bar 590 formed at the stopper 530 by the rotating action. Therefore, the stopper 530 is returned by the return spring 533, also, since the return guide 540 formed at the stopper 530 is released from the cam 550, the cutter 520 installed at the distal end of the rotary shaft 501 is rotated at a certain extent to prevent the extraction pipe 515 from being blocked by the one-way clutch bearing 519 installed at the cam 550 and the rotary shaft 501 by the resilient force of the torsion spring 560 interposed between the supporter 517 and the cam 550.

INDUSTRIAL APPLICABILITY

As described hereinabove, an apparatus for automatically binding reinforcing rods of the present invention is capable of reducing a weight of the auto-binder in order to drive the binding-wire twisting device for twisting the rotary gear and the binding-wire by means of one driving motor, and remarkably reducing a construction cost of the field by rapidly accomplishing a binding operation in the construction field since the binding-wire feeding device and the binding-wire cutting device is more precisely operated.

While this invention has been described in connection with what is presently considered to be the most practical and preferred embodiment, it is to be understood that the invention is not limited to the disclosed embodiment, but on the contrary, it is intended to cover various modification within the spirit and scope of the appended claims.

The invention claimed is:

1. An apparatus for automatically binding reinforcing rods comprising an operation lever for advancing forward a binding-wire, a rotary gear installed at a rotary binding-wire guider to surround the reinforcing rods, and a binding fan for twisting both ends of the binding-wire cut by a cutter blade, characterized in that the apparatus comprises:

a case having a predetermined shape at which reinforcing rods are forwardly attached;

a binding-wire supplying device of which a binding-wire is wound on a cylindrical reel formed at a rear part of the case;

a binding-wire feeding device for advancing the binding-wire by moving forward the binding-wire supplied from the binding-wire supplying device in a state that the binding-wire is caught by an operation of an activating lever, and operating a first switch;

a rotary binding-wire guiding device at which the advanced binding-wire is mounted on the rotary gear by the binding-wire feeding device and the driving motor is rotated by the operation of the first switch to make the rotary gear rotate around the reinforcing rods to surround the reinforcing rods;

a binding-wire cutting device for cutting the binding-wire wound on the reinforcing rods as the driving motor is reversely rotated by operating a second switch by using the rotary gear of the rotary binding-wire guiding device; and a binding-wire twisting device for twisting the binding-wire by a twister formed at one end of a twister shaft by a rotational force generated from the driving motor in order to twist the both ends of the binding-wire cut by the binding-wire cutting device.

2. The apparatus for automatically binding reinforcing rods according to claim 1, characterized in that the binding-wire feeding device is fixedly rotated to a feeding hinge when the operation lever is retracted, its one side is hinged to the operation lever, and the feeder is advanced at the other side by a feeding shaft hinged to the feeder.

3. The apparatus for automatically binding reinforcing rods according to claim 1, characterized in that an inserting hole, in which the binding-wire extracted from the binding-wire supplying device is inserted and guided to a front end, is formed; and a feeder is hinged to press the binding-wire with a feeding pin by a resilient force of a spring as a certain section of the inserting hole is exposed.

4. The apparatus for automatically binding reinforcing rods according to claim 1, characterized in that the rotary binding-wire guiding device comprises:

a driven bevel gear engaged with a driving bevel gear formed at a shaft of the driving motor to transmit a power;

a timing driving gear integrally formed with the driven bevel gear;

a first and a second timing gears, on which a timing belt for transmitting a rotational force of the timing driving gear, installed at an adjacent section of a linear gear; and a first and a second pinions integrally formed with the first and the second timing gears, and wherein the rotary binding-wire guiding device rotates the rotary gear at which a reinforcing rod guider for attaching the reinforcing rods is formed.

5. The apparatus for automatically binding reinforcing rods according to claim 1, characterized in that the rotary gear has a slot for preventing the binding-wire from separating during a rotation of the rotary gear into a section in vicinity of the binding-wire cutting device at one side, and a binding-wire catching protrusion formed at the slot and at which the binding-wire is caught.

6. The apparatus for automatically binding reinforcing rods according to claim 1, characterized in that the rotary gear is provided with a protruded surface for operating the second switch at an opposite surface of the surface at which the catching protrusion is installed.

7. The apparatus for automatically binding reinforcing rods according to claim 1, characterized in that the binding-wire cutting device comprises:

a cutter installed at a section in vicinity of an extraction pipe installed at an extended line in an advancing direction of the binding-wire extracted from the binding-wire feeding device;

a supporter, at which a rotary shaft for rotating the cutter is installed, integrally formed with the extracting pipe;

a one-way clutch bearing fixed to the supporter to support the rotary shaft; and a torsion spring installed at the other side of the cutter of the rotary shaft to return the cutter.

8. The apparatus for automatically binding reinforcing rods according to claim 1, characterized in that the binding-wire cutting device comprises, a twister driving gear, at which the one-way clutch bearing is installed to be rotated in an opposite direction to a rotational direction of the driving bevel gear in a state of adjacent of the driving bevel gear installed at the driving shaft of the driving motor, is cooperated with a twister driven gear installed at a distal end of the twister shaft in order to cut the binding-wire as a pestle, installed at the twister shaft and having a regular gap by a hooking pin, strikes a blade of the cutter.

9. The apparatus for automatically binding reinforcing rods according to claim 1, characterized in that the apparatus further comprises:

a cam installed at a periphery of the one-way clutch bearing supporting the rotary shaft of the supporter;

a return guide which a certain slope is formed to guide the cam;

a stopper, at which the return guide is attached, extended from the operation lever;

a catching bar formed at the stopper to pull the stopper in a moving direction of the operation lever; and a latch having a hook to be locked to the catching bar at its one end, a protrusion at the other end, and a compression spring hinged to the hook and a center of the protrusion and installed at a bottom surface of the hook to prevent the hook from sagging, and wherein the protrusion is caught by a hook falling bar fixed to the case to rotate the hook to be separated from the catching bar when the latch is moved to more than a certain distance along the operation lever.

10. The apparatus for automatically binding reinforcing rods according to claim 2, characterized in that an inserting hole, in which the binding-wire extracted from the binding-wire supplying device is inserted and guided to a front end, is formed; and a feeder is hinged to press the binding-wire with a feeding pin by a resilient force of a spring as a certain section of the inserting hole is exposed.

11. The apparatus for automatically binding reinforcing rods according to claim 4, characterized in that the rotary gear has a slot for preventing the binding-wire from separating during a rotation of the rotary gear into a section in vicinity of the binding-wire cutting device at one side, and a binding-wire catching protrusion formed at the slot and at which the binding-wire is caught.

12. The apparatus for automatically binding reinforcing rods according to claim 11, characterized in that the rotary gear is provided with a protruded surface for operating the second switch at an opposite surface of the surface at which the catching protrusion is installed.

13. The apparatus for automatically binding reinforcing rods according to claim 4, characterized in that the rotary gear is provided with a protruded surface for operating the second switch at an opposite surface of the surface at which the catching protrusion is installed.

14. The apparatus for automatically binding reinforcing rods according to claim 7, characterized in that the binding-wire cutting device comprises, a twister driving gear, at which the one-way clutch bearing is installed to be rotated in an opposite direction to a rotational direction of the driving bevel gear in a state of adjacent of the driving bevel gear installed at the driving shaft of the driving motor, is cooperated with a twister driven gear installed at a distal end of the twister shaft in order to cut the binding-wire as a pestle, installed at the twister shaft and having a regular gap by a hooking pin, strikes a blade of the cutter.

15. The apparatus for automatically binding reinforcing rods according to claim 7, characterized in that the apparatus further comprises:

a cam installed at a periphery of the one-way clutch bearing supporting the rotary shaft of the supporter;

a return guide which a certain slope is formed to guide the cam;

a stopper, at which the return guide is attached, extended from the operation lever;

a catching bar formed at the stopper to pull the stopper in a moving direction of the operation lever; and a latch having a hook to be locked to the catching bar at its one end, a protrusion at the other end, and a compression spring hinged to the hook and a center of the protrusion and installed at a bottom surface of the hook to prevent the hook from sagging, and wherein the protrusion is caught by a hook falling bar fixed to the case to rotate the hook to be separated from the catching bar when the latch is moved to more than a certain distance along the operation lever.

* * * * *